US011840920B1

(12) United States Patent
Almarzooq et al.

(10) Patent No.: US 11,840,920 B1
(45) Date of Patent: Dec. 12, 2023

(54) DOWNHOLE FLUID ACQUISITION, HIDDEN PAY IDENTIFICATION, AND STIMULATION SYSTEM AND METHOD

(71) Applicant: Saudi Arabian Oil Company, Dhahran (SA)

(72) Inventors: Anas Mohammedali Almarzooq, Dhahran (SA); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/903,633

(22) Filed: Sep. 6, 2022

(51) Int. Cl.

| | |
|---|---|
| ***E21B 47/11*** | (2012.01) |
| ***E21B 49/10*** | (2006.01) |
| *E21B 43/16* | (2006.01) |
| *E21B 43/12* | (2006.01) |
| *E21B 47/10* | (2012.01) |

(52) U.S. Cl.
CPC ..... *E21B 47/11* (2020.05); *E21B 49/10* (2013.01); *E21B 43/12* (2013.01); *E21B 43/162* (2013.01); *E21B 47/10* (2013.01)

(58) Field of Classification Search
CPC ..... E21B 47/11; E21B 47/10; E21B 49/10; E21B 43/12; E21B 43/162
See application file for complete search history.

(56) References Cited

U.S. PATENT DOCUMENTS

| | | | | |
|---|---|---|---|---|
| 5,168,927 | A | 12/1992 | Stegemeier et al. | |
| 8,191,416 | B2 * | 6/2012 | Kuchuk | E21B 49/008 73/152.41 |
| 8,528,635 | B2 * | 9/2013 | Harrison | E21B 49/008 166/305.1 |
| 2011/0303409 | A1 * | 12/2011 | Harrigan | E21B 49/08 166/69 |
| 2015/0361791 | A1 * | 12/2015 | Gisolf | E21B 49/008 166/264 |

FOREIGN PATENT DOCUMENTS

| | | | |
|---|---|---|---|
| CA | 2402163 | A1 | 7/2001 |
| CN | 107740690 | A | 2/2018 |
| GB | 2569868 | A | 7/2019 |
| WO | 2014091144 | A2 | 6/2014 |
| WO | 2018143814 | A1 | 8/2018 |

* cited by examiner

*Primary Examiner* — D. Andrews
(74) *Attorney, Agent, or Firm* — Bracewell LLP; Constance G. Rhebergen; Brian H. Tompkins

(57) ABSTRACT

A hydrocarbon well downhole fluid acquisition and injection system for selecting and stimulating zones based on operations of the system. Target depths in a hydrocarbon well are identified, and reservoir fluids may be acquired or tagging agents may be injected at the target depths using a specialized hydrocarbon well downhole fluid acquisition and injection system. The well may be operated to generate flow of fluids, and the reservoir fluids may be monitored and assessed for the presence of tagging agents. The presence of tagging agents and the fluid sample may be assessed to identify zones that may be candidates for stimulation or other operations.

20 Claims, 9 Drawing Sheets

DOWNHOLE FLUID ACQUISITION, HIDDEN PAY IDENTIFICATION, AND STIMULATION SYSTEM AND METHOD

FIELD

Embodiments relate generally to hydrocarbon exploration of wells, and more particularly to hydrocarbon reservoir fluid acquisition and stimulation.

BACKGROUND

A rock formation that resides under the Earth's surface is often referred to as a "subsurface" formation. A subsurface formation that contains a subsurface pool of hydrocarbons, such as oil and gas, is often referred to as a "hydrocarbon reservoir." Hydrocarbons are typically extracted (or "produced") from a hydrocarbon reservoir by way of a hydrocarbon well. A hydrocarbon well normally includes a wellbore (or "borehole") that is drilled into the reservoir. For example, a hydrocarbon well may include a wellbore that extends into the rock of a reservoir to facilitate the extraction (or "production") of hydrocarbons from the reservoir, the injection of fluids into the reservoir, or the evaluation and monitoring of the reservoir.

Developing a hydrocarbon well for production typically involves a drilling stage, a completion stage, and a production stage. The drilling stage involves drilling a wellbore into a portion of the formation that is expected to contain hydrocarbons (often referred to as a "hydrocarbon reservoir" or a "reservoir"). The drilling process is often facilitated by a drilling rig that provides for a variety of drilling operations, such as operating a drill bit to cut (or "drill") the formation to form the wellbore. The completion stage involves operations for making the well (wellbore along the depth of the formation as well as the wellhead on the surface) ready to produce hydrocarbons, such as installing casing, installing production tubing, installing valves for regulating production flow, or pumping substances into the well to fracture, clean or otherwise prepare the well and reservoir to produce hydrocarbons. The production stage involves producing hydrocarbons from the reservoir by way of the well. During the production stage, the drilling rig is typically replaced with a production tree at the wellhead having valves that are operated to, for example, regulate production flow rate and pressure. The production tree normally includes an outlet that is connected to a distribution network of midstream facilities, such as tanks, pipelines, or transport vehicles, that transport production from the well to downstream facilities, such as refineries or export terminals.

Development of a hydrocarbon reservoir typically involves a series of operations directed to optimizing extraction of hydrocarbons from the reservoir. For example, a reservoir operator may spend a great deal of time and effort assessing a hydrocarbon reservoir to identify an economical and environmentally responsible plan to extract hydrocarbons from the reservoir and may engage in well drilling, completion, and production operations to extract hydrocarbons from the reservoir in accordance with the plan. This can include identifying characteristics of reservoir rock, determining where hydrocarbons are located in the reservoir rock, determining where wells should be drilled, generating a field development plan (FDP) that outlines parameters for extracting hydrocarbons from the reservoir, and drilling and operating wells in accordance with the parameters of the FDP. An FDP for a hydrocarbon reservoir may, for example, specify locations, trajectories, and operational parameters for wells in the reservoir.

SUMMARY

Identifying characteristics of a formation can be an important aspect of effectively and efficiently developing a hydrocarbon reservoir. For example, a reservoir operator may desire to know characteristics of formations at different depths to predict how the wells and the reservoir may perform, and to determine parameters for developing the reservoir. Although existing techniques enable downhole testing of formations to determine how a given depth is expected to perform, these techniques typically involve multiple runs of tools that increase cost and complexity, and, in turn, can limit the number of depths that are tested. In many instances, several depth intervals (also referred to as "zones," "pay zones," or "pays") contribute to production flow from a wellbore. Unfortunately, limiting the number of depths tested may prevent an operator from fully identifying contributing and non-contributing zones. This can make it difficult to predict how a well will perform and to determine parameters for developing the well and the reservoir.

Provided in some embodiments is a hydrocarbon well downhole fluid acquisition injection system, and associated techniques for selecting and stimulating zones based on operations of the system. Described embodiments may provide for identifying intervals that are flow contributing, damaged (e.g., zones masked by drilling fluid invasion) or low quality (e.g., including low reservoir quality rocks of low porosity or low permeability) that are candidates for stimulation or other remediation techniques. Described embodiments, may, for example, be combined with nitrogen ($N_2$) lifting to evaluate the best setting depth and circulation rate to obtain flow from targeted "tagged" formations. Described embodiments may also provide for differentiating between damaged zones versus low quality rock units utilizing integration of laboratory measurements data into the formation rock units, which may allow prediction of effects fluid invasion on different rock types, which can help to improve drilling fluid design and distinguish between damaged zones and low-quality rocks.

In some embodiments, target depths in a hydrocarbon well are identified (e.g., based on open-hole logs), formation fluid (which may include drilling fluid filtrate) samples are acquired or tagging agents (e.g., noble gases) are injected at the target depths using a specialized hydrocarbon well downhole fluid acquisition and injection system. The well may be operated (or "flowed) to generate flow of reservoir fluids (e.g., production fluids) from the wellbore, and the produced reservoir fluids may be monitored and assessed for the presence of tagging agents. The presence (or non-presence) of tagging agents and the fluid sample may be assessed to identify zones that may (or may not be) candidates for stimulation or other operations.

In one embodiment, a hydrocarbon well downhole fluid acquisition and injection system is provided. The system includes a downhole fluid acquisition and injection tool configured to be disposed downhole in a wellbore of a hydrocarbon well extending into a formation containing a hydrocarbon reservoir. The downhole fluid acquisition and injection tool includes tagging agent containers configured to house tagging agents. The containers include a first tagging agent container configured to house a first tagging agent and a second tagging agent container configured to house a second tagging agent. The downhole fluid acquisition and injection tool includes a fluid sample container configured to house reservoir fluid extracted from the hydrocarbon reservoir. The downhole fluid acquisition and injection tool includes a fluid port configured to penetrate a mud cake and contact a surface of the formation to facilitate the communication of fluids between the hydrocarbon reservoir and the downhole fluid acquisition and injection tool. The downhole fluid acquisition and injection tool includes a fluid pump configured to pump, into the fluid sample container, reservoir fluid extracted from the hydrocarbon reservoir by way of the fluid port and pump, into the hydrocarbon reservoir by way of the fluid port, tagging agents from the tagging agent containers. The downhole fluid acquisition and injection tool includes fluid control valves configured to route reservoir fluid extracted from the hydrocarbon reservoir by way of the fluid port to the pump and into the fluid sample container and route tagging agents from the tagging agent containers to the pump and into the hydrocarbon reservoir by way of the fluid port. The downhole fluid acquisition and injection tool includes an isolation system configured to isolate a test interval of the formation from interferences of adjacent formation or the wellbore. The isolation system includes an upper packer configured to seal against the wall of the wellbore to isolate the test interval from an upper portion of the wellbore located up-hole of the downhole fluid acquisition and injection tool and a lower packer configured to seal against the wall of the wellbore to isolate the test interval from a lower portion of the wellbore located downhole of the downhole fluid acquisition and injection tool. The downhole fluid acquisition and injection tool includes an output/cleaning port configured to be in fluid communication with the lower or upper portion of the wellbore. The fluid control valves include a sample valve configured to regulate flow of reservoir fluid between the fluid port and an inlet of the pump, a sample-container valve configured to regulate flow of reservoir fluid between the pump and the sample container, an output/cleaning valve configured to regulate flow of reservoir fluid between an output of the pump and the output/cleaning port, and a tagging valve system configured to regulate flow of tagging agents between tagging agent containers and the input of the pump. The tagging valve system includes a first tagging valve configured to regulate flow of the first tagging agent between the first tagging agent container and the inlet of the pump and a second tagging valve configured to regulate flow of the second tagging agent between the second tagging agent container and the inlet of the pump. The fluid control valves include an injection valve system configured to regulate flow of the tagging agents between the output of the pump and the fluid port, the injection valve system having a first injection valve between the output of the pump and the fluid port and a second injection valve between the first injection valve and the fluid port. The downhole fluid acquisition and injection tool is configured to operate in a cleaning state that includes the upper packer and lower packer in sealing contact with the wall of the wellbore, the fluid port in contact with the surface of the formation, the pump operating and the following valves operating in an open state: the sample valve and the output/cleaning valve, to generate a flow of reservoir fluid into the fluid port and out of the output/cleaning port and into the lower or upper portion of the wellbore. The downhole fluid acquisition and injection tool is configured to operate in a sampling state that includes the upper packer and lower packer in sealing contact with the wall of the wellbore, the fluid port in contact with the wall of the wellbore, the pump operating, and the following valves operating in an open state: the sample valve and the sample-container valve, to generate a flow of reservoir fluid into the fluid port and into the sample container. The downhole fluid acquisition and injection tool is configured to operate in a first tagging state that includes the upper packer and lower packer in sealing contact with the wall of the wellbore, the fluid port in contact with the surface of the formation, the pump operating, and the following valves operating in an open state: the first tagging valve, the first injection valve, and the second injection valve, to generate a flow of the first tagging agent out of the first tagging agent container, through the fluid port and into formation rock of the hydrocarbon reservoir, to inject the first tagging agent into the formation rock of the hydrocarbon reservoir. The downhole fluid acquisition and injection tool is configured to operate in a second tagging state that includes the upper packer and lower packer in sealing contact with the wall of the wellbore, the fluid port in contact with the surface of the formation, the pump operating and the following valves operating in an open state: the second tagging valve, the first injection valve, and the second injection valve, to generate a flow of the second tagging agent out of the second tagging agent container, through the fluid port and into formation rock of the hydrocarbon reservoir, to inject the second tagging agent into the formation rock of the hydrocarbon reservoir.

In some embodiments, the system includes a well control system configured to control the well to operate in a flowing state to produce reservoir fluids from the formation, monitor the produced reservoir fluids for tagging agents, determine the presence of the first or second tagging agent, determine, responsive to determining the presence of the first or second tagging agent, a depth interval of the hydrocarbon well that is a candidate for stimulation, and conduct, responsive to determining the depth interval of the hydrocarbon well that is a candidate for the stimulation operation, a stimulation operation on the depth interval of the formation of the hydrocarbon well. In some embodiments, the stimulation operation includes injection of a stimulation agent into formation rock at the depth interval of the wellbore of the hydrocarbon well.

In another embodiment, a hydrocarbon well downhole fluid acquisition and injection system is provided. The system includes a downhole fluid acquisition and injection tool configured to be disposed downhole in a wellbore of a hydrocarbon well extending into a formation containing a hydrocarbon reservoir. The downhole fluid acquisition and injection tool includes tagging agent containers configured to house tagging agents. The containers include a first tagging agent container configured to house a first tagging agent and a second tagging agent container configured to house a second tagging agent. The downhole fluid acquisition and injection tool includes a fluid sample container configured to house reservoir fluid extracted from the hydrocarbon reservoir. The downhole fluid acquisition and injection tool includes a fluid port configured to contact a surface of the formation to facilitate the communication of fluids between the hydrocarbon reservoir and the downhole fluid acquisition and injection tool. The downhole fluid acquisition and injection tool includes a fluid pump configured to pump, into the fluid sample container, reservoir fluid extracted from the hydrocarbon reservoir by way of the fluid port and pump, into the hydrocarbon reservoir by way of the fluid port, tagging agents from the tagging agent containers. The downhole fluid acquisition and injection tool includes fluid control valves configured to route reservoir fluid extracted from the hydrocarbon reservoir by way of the fluid port to the pump and into the fluid sample container and route tagging agents from the fluid sample container to the pump and into the hydrocarbon reservoir by way of the fluid port. The downhole fluid acquisition and injection tool includes an isolation system configured to isolate a test interval of the formation interference of adjacent formations or from the wellbore. The isolation system includes an upper packer configured to seal against the wall of the wellbore to isolate the test interval from an upper portion of the wellbore located up-hole of the downhole fluid acquisition and injection tool and a lower packer configured to seal against the wall of the wellbore to isolate the test interval from a lower portion of the wellbore located downhole of the downhole fluid acquisition and injection tool. The isolation system includes an output/cleaning port configured to be in fluid communication with the lower portion of the wellbore. The fluid control valves include a sample valve configured to regulate flow of reservoir fluid between the fluid port and an inlet of the pump, a sample-container valve configured to regulate flow of reservoir fluid between the pump and the sample container, an output/cleaning valve configured to regulate flow of reservoir fluid between an output of the pump and the output/cleaning port, and a tagging valve system configured to regulate flow of tagging agents between tagging agent containers and the input of the pump. The tagging valve system includes a first tagging valve configured to regulate flow of the first tagging agent between the first tagging agent container and the inlet of the pump and a second tagging valve configured to regulate flow of the second tagging agent between the second tagging agent container and the inlet of the pump. The injection valve system is configured to regulate flow of reservoir fluid between the output of the pump and the fluid port, the injection valve system having a first injection valve between the output of the pump and the fluid port.

In some embodiments, the downhole fluid acquisition and injection tool is configured to operate in a cleaning state that includes the upper packer and lower packer in sealing contact with the wall of the wellbore, the fluid port in contact with the surface of the formation, the pump operating and the following valves operating in an open state: the sample valve, and the output/cleaning valve, to generate a flow of reservoir fluid into the fluid port and out of the output/cleaning port and into the lower or upper portion of the wellbore. In some embodiments, the downhole fluid acquisition and injection tool is configured to operate in a sampling state that includes the upper packer and lower packer in sealing contact with the wall of the wellbore, the fluid port in contact with the wall of the wellbore, the pump operating, and the following valves operating in an open state: the sample valve and the sample-container valve, to generate a flow of reservoir fluid into the fluid port and into the sample container. In some embodiments, the downhole fluid acquisition and injection tool is configured to operate in a first tagging state that includes the upper packer and lower packer in sealing contact with the wall of the wellbore, the fluid port in contact with the surface of the formation, the pump operating, and the following valves operating in an open state: the first tagging valve, the first injection valve, and the second injection valve, to generate a flow of the first tagging agent out of the first tagging agent container, through the fluid port and into formation rock of the hydrocarbon reservoir, to inject the first tagging agent into the formation rock of the hydrocarbon reservoir. In some embodiments, the downhole fluid acquisition and injection tool is configured to operate in a second tagging state that includes the upper packer and lower packer in sealing contact with the wall of the wellbore, the fluid port in contact with the surface of the formation, the pump operating and the following valves operating in an open state: the second tagging valve, the first injection valve, and the second injection valve, to generate a flow of the second tagging agent out of the second tagging agent container, through the fluid port and into formation rock of the hydrocarbon reservoir, to inject the second tagging agent into the formation rock of the hydrocarbon reservoir. In some embodiments, the injection valve system includes a second injection valve between the first injection valve and the fluid port. In some embodiments, the system includes a well control system configured to control the well to operate in a flowing state to produce reservoir fluids from the formation, monitor the produced reservoir fluids for tagging agents, determine the presence of the first or second tagging agent, determine, responsive to determining the presence of the first or second tagging agent, a depth interval of the hydrocarbon well that is a candidate for stimulation, and conduct, responsive to determining the depth interval of the hydrocarbon well that is a candidate for the stimulation operation, a stimulation operation on the depth interval of the formation of the hydrocarbon well. In some embodiments, the stimulation operation includes injection of a stimulation agent into formation rock at the depth interval of the wellbore of the hydrocarbon well.

In some embodiments, a method is provided that includes disposing a downhole fluid acquisition and injection tool downhole in a wellbore of a hydrocarbon well extending into a formation containing a hydrocarbon reservoir. The downhole fluid acquisition and injection tool includes tagging agent containers configured to house tagging agents. The containers include a first tagging agent container configured to house a first tagging agent and a second tagging agent container configured to house a second tagging agent. The downhole fluid acquisition and injection tool includes a fluid sample container configured to house reservoir fluid extracted from the hydrocarbon reservoir. The downhole fluid acquisition and injection tool includes a fluid port configured to contact a surface of the formation to facilitate the communication of fluids between the hydrocarbon reservoir and the downhole fluid acquisition and injection tool. The downhole fluid acquisition and injection tool includes a fluid pump configured to pump, into the fluid sample container, reservoir fluid extracted from the hydrocarbon reservoir by way of the fluid port and pump, into the hydrocarbon reservoir by way of the fluid port, tagging agents from the tagging agent containers. The downhole fluid acquisition and injection tool includes fluid control valves configured to route reservoir fluid extracted from the hydrocarbon reservoir by way of the fluid port to the pump and into the fluid sample container and route tagging agents from the fluid sample container to the pump and into the hydrocarbon reservoir by way of the fluid port. The downhole fluid acquisition and injection tool includes an isolation system configured to isolate a test interval of the formation interference of adjacent formations or from the wellbore. The isolation system includes an upper packer configured to seal against the wall of the wellbore to isolate the test interval from an upper portion of the wellbore located up-hole of the downhole fluid acquisition and injection tool and a lower packer configured to seal against the wall of the wellbore to isolate the test interval from a lower portion of the wellbore located downhole of the downhole fluid acquisition and injection tool. The isolation system includes an output/cleaning port configured to be in fluid communication with the lower portion of the wellbore. The fluid control valves include a sample valve configured to regulate flow of reservoir fluid between the fluid port and an inlet of the pump, a sample-container valve configured to regulate flow of reservoir fluid between the pump and the sample container, an output/cleaning valve configured to regulate flow of reservoir fluid between an output of the pump and the output/cleaning port, and a tagging valve system configured to regulate flow of tagging agents between tagging agent containers and the input of the pump. The tagging valve system includes a first tagging valve configured to regulate flow of the first tagging agent between the first tagging agent container and the inlet of the pump and a second tagging valve configured to regulate flow of the second tagging agent between the second tagging agent container and the inlet of the pump. The injection valve system is configured to regulate flow of reservoir fluid between the output of the pump and the fluid port, the injection valve system having a first injection valve between the output of the pump and the fluid port. The method also includes operating the downhole fluid acquisition and injection tool to conduct a sampling operation to collect a fluid sample from the reservoir and one or more tagging operations at different depths along the wellbore to inject the first and second tagging agents into the reservoir.

In some embodiments, the method includes operating the downhole fluid acquisition and injection tool in a cleaning state that includes the upper packer and lower packer in sealing contact with the wall of the wellbore, the fluid port in contact with the surface of the formation, the pump operating and the following valves operating in an open state: the sample valve; and the output/cleaning valve, to generate a flow of reservoir fluid into the fluid port and out of the output/cleaning port and into the lower or upper portion of the wellbore. In some embodiments, the sampling operation includes operating the downhole fluid acquisition and injection tool in a sampling state that includes the upper packer and lower packer in sealing contact with the wall of the wellbore, the fluid port in contact with the wall of the wellbore, the pump operating, and the following valves operating in an open state: the sample valve and the sample-container valve, to generate a flow of reservoir fluid into the fluid port and into the sample container. In some embodiments, a first tagging operation of the one or more tagging operations includes operating the downhole fluid acquisition and injection tool in a first tagging state that includes the upper packer and lower packer in sealing contact with the wall of the wellbore, the fluid port in contact with the surface of the formation, the pump operating, and the following valves operating in an open state: the first tagging valve, the first injection valve, and the second injection valve, to generate a flow of the first tagging agent out of the first tagging agent container, through the fluid port and into formation rock of the hydrocarbon reservoir, to inject the first tagging agent into the formation rock of the hydrocarbon reservoir. In some embodiments, In some embodiments, a second tagging operation of the one or more tagging operations includes operating in a second tagging state that includes the upper packer and lower packer in sealing contact with the wall of the wellbore, the fluid port in contact with the surface of the formation, the pump operating and the following valves operating in an open state: the second tagging valve, the first injection valve, and the second injection valve, to generate a flow of the second tagging agent out of the second tagging agent container, through the fluid port and into formation rock of the hydrocarbon reservoir, to inject the second tagging agent into the formation rock of the hydrocarbon reservoir. In some embodiments, the injection valve system includes a second injection valve between the first injection valve and the fluid port. In some embodiments, the method includes controlling the well to operate in a flowing state to produce reservoir fluids from the formation, monitoring the produced reservoir fluids for tagging agents, determining the presence of the first or second tagging agent, determining, responsive to determining the presence of the first or second tagging agent, a depth interval of the hydrocarbon well that is a candidate for stimulation, and conducting, responsive to determining the depth interval of the hydrocarbon well that is a candidate for the stimulation, a stimulation operation on the depth interval of the formation of the hydrocarbon well. In some embodiments, the stimulation operation includes injection of a stimulation agent into formation rock at the depth interval of the wellbore of the hydrocarbon well. In some embodiments, the sampling operation and one or more tagging operations are conducted during a single run of the downhole fluid acquisition and injection tool in the wellbore of the well.

Figure 1:
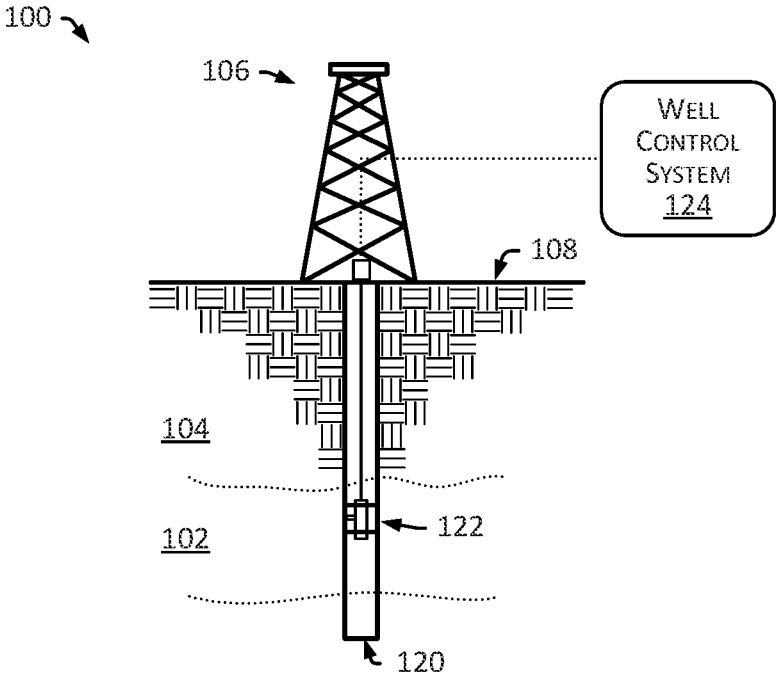
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. The drawings and the detailed descriptions are not intended to limit the disclosure to the form disclosed, but are intended to disclose modifications, equivalents, and alternatives falling within the scope of the disclosure as defined by the claims.

DETAILED DESCRIPTION

Described are embodiments of novel hydrocarbon well downhole fluid acquisition and injection system, and associated techniques for selecting and stimulating zones based on operations of the system. In some embodiments, target depths in a hydrocarbon well are identified (e.g., based on open-hole logs), formation fluid samples are acquired or tagging agents (e.g., noble gases) are injected at the target depths using a specialized hydrocarbon well downhole fluid acquisition and injection system. The well may be operated (or "flowed) to generate flow of reservoir fluids (e.g., production fluids) from the wellbore, and the reservoir fluids may be monitored and assessed for the presence of tagging agents. The presence (or non-presence) of tagging agents and the fluid sample may be assessed to identify zones that may (or may not be) candidates for stimulation or other operations.

FIG. 1 is a diagram that illustrates a well environment 100 in accordance with one or more embodiments. In the illustrated embodiment, the well environment 100 includes a reservoir ("reservoir") 102 located in a subsurface formation ("formation") 104, and a well system ("well") 106.

The formation 104 may include a porous or fractured rock formation that resides beneath the earth's surface (or "surface") 108. The reservoir 102 may be a hydrocarbon reservoir defined by a portion of the formation 104 that contains (or that is at least determined or expected to contain) a subsurface pool of hydrocarbons, such as oil and gas. The formation 104 and the reservoir 102 may each include layers of rocks having varying characteristics, such as varying degrees of permeability, porosity, and fluid saturation. In the case of the well 106 being operated as a production well, the well 106 may be a hydrocarbon production well that is operable to facilitate the extraction of hydrocarbons (or "production"), such as oil or gas, from the reservoir 102. In the case of the well 106 being operated as an injection well, the well 106 may be operable to facilitate the injection of substances, such as water or gas, into the reservoir 102.

The well 106 may include a wellbore 120, a downhole fluid acquisition and injection system (or "fluid acquisition and injection tool" or "tool") 122 and a well control system ("control system") 124. The wellbore 120 may be a bored hole that extends from the surface 108 into a target zone of the formation 104, such as the reservoir 102. The wellbore 120 may be created, for example, by a drill bit of a drilling system of the well 106 boring through the formation 104. An upper end of the wellbore 120 (e.g., located at or near the surface 108) may be referred to as the "up-hole" end of the wellbore 120. A lower end of the wellbore 120 (e.g., terminating in the formation 104) may be referred to as the "downhole" end of the wellbore 120.

Figure 2:
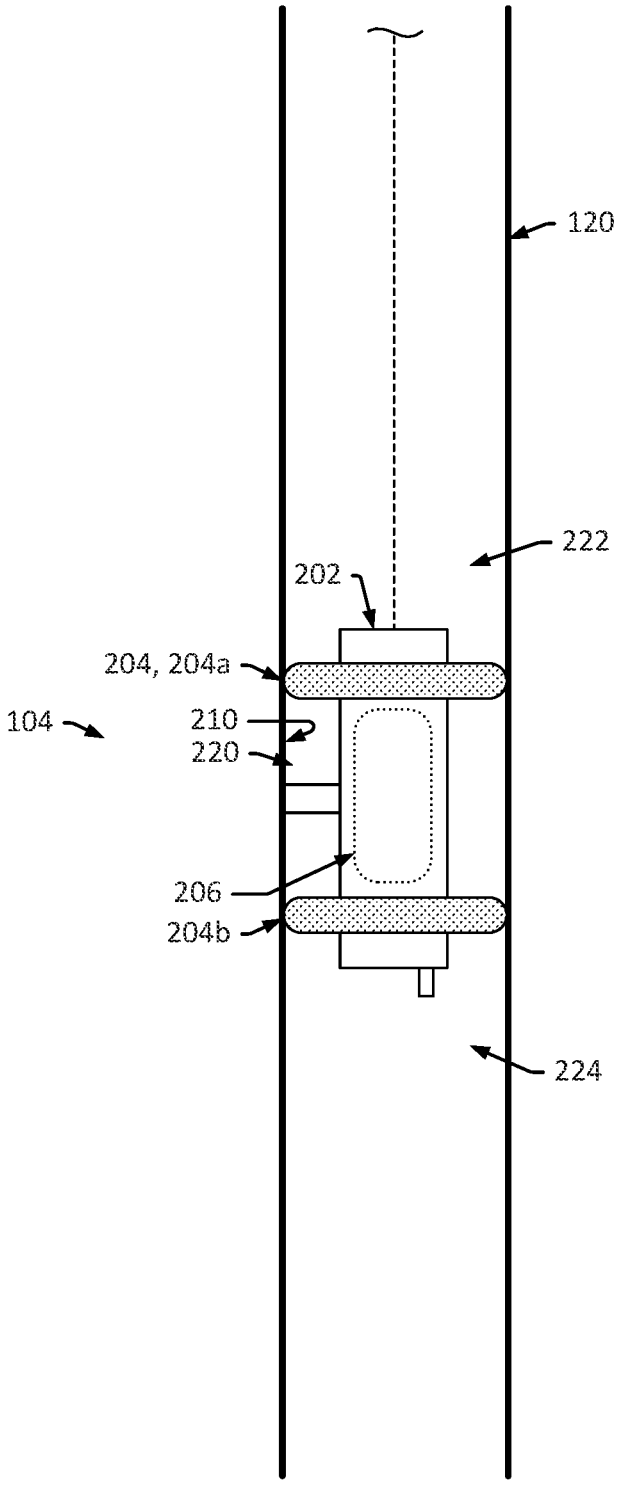
FIG. 2 is a diagram that illustrates a downhole fluid acquisition and injection system disposed in a wellbore in accordance with one or more embodiments.

In some embodiments, the tool 122 is a device that facilitates the acquisition of fluids from, and injection of fluids into, the formation surrounding the wellbore 120. FIG. 2 is a diagram that illustrates components of the tool 122 in accordance with one or more embodiments. In the illustrated embodiment, the tool 122 includes a tool body (or "housing") 202, an isolation system such as packers 204, and a fluid communication system 206. In some embodiments, the tool body 202 includes a rigid structure housing components of the fluid communication system 206. For example, the tool body 202 may include a metal cylindrical housing that encapsulates components (e.g., the reservoirs or fluid containers, the valves and the pump) of the tool 122. In some embodiments, the packers 204 are operable to isolate a test interval 220 of the formation 104 from other portions of the formation 104, to isolate the test interval 220 from interferences from adjacent formations, and to isolate the test interval 220 from the wellbore 120. The test interval 220 may be a depth or several depths between the two packers 204. In the illustrated embodiment, the packers 204 include an upper packer 204*a* that is operable to seal against the wall 210 of the wellbore 120 to isolate the test interval 220 from an upper portion 222 of the wellbore 120 (located up-hole of the tool 122), and a lower packer 204*b* that is operable to seal against the wall 210 of the wellbore 120 to isolate the test interval 220 from a lower portion 224 of the wellbore 120 (located downhole of the tool 122). The upper packer 204*a* and the lower packer 204*b* may each include, for example, inflatable bladders that are inflated to provide a respective fluid seal that isolates the test interval 220 from the upper portion 222 and the lower portion 224 of the wellbore 120. In some embodiments, the fluid communication system 206 is operable to acquire fluid samples from the rock of the formation 104 surrounding the wellbore 120 or to inject tagging agents into the rock of the formation 104 surrounding the wellbore 120.

Figure 3:
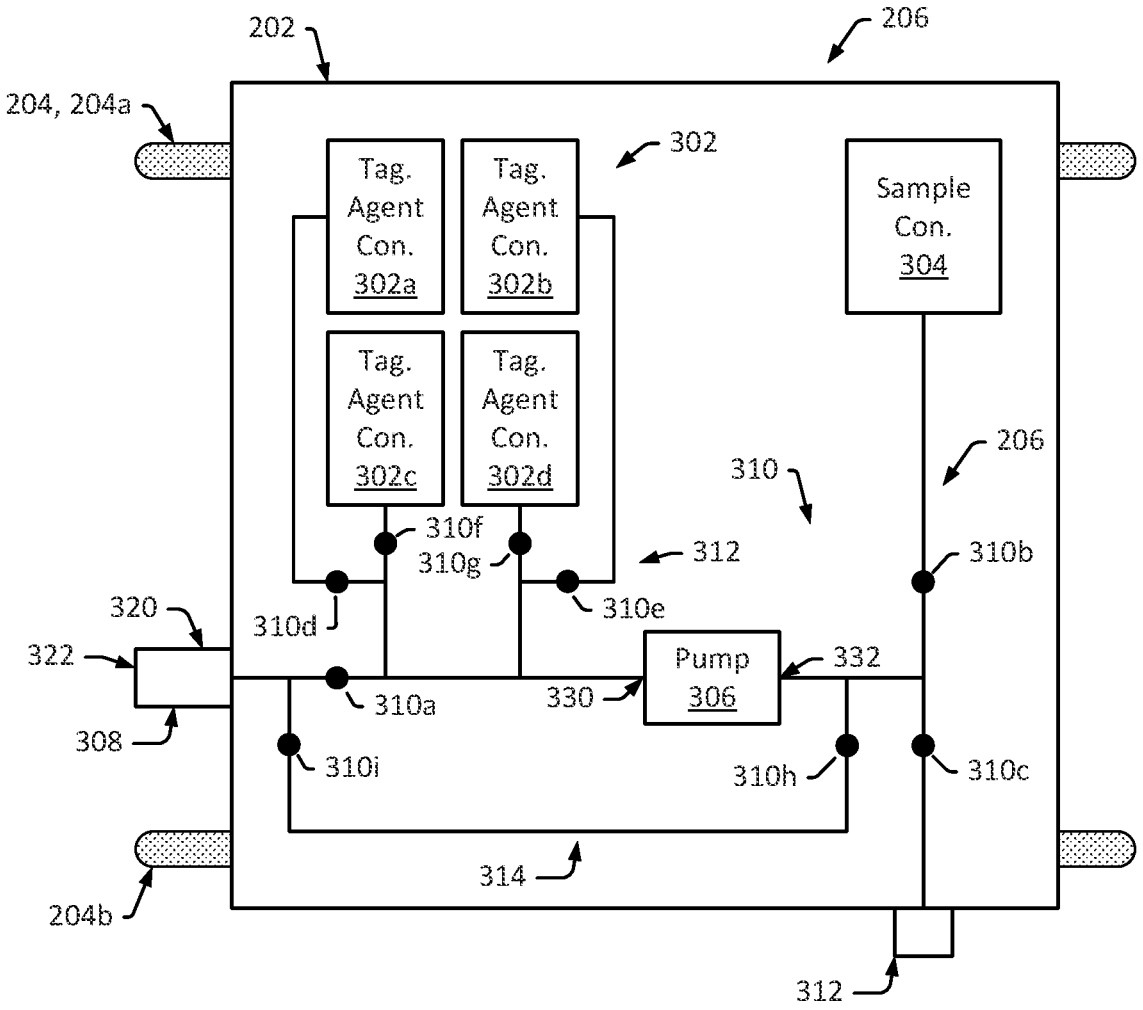
FIG. 3 is a diagram that illustrate aspects of a downhole fluid acquisition and injection system in a well in accordance with one or more embodiments.

FIG. 3 is a diagram that illustrates the tool 122 in accordance with one or more embodiments. In the illustrated embodiment, the fluid communication system 206 includes tagging agent containers 302, a fluid sample container 304, a pump 306, an input/output (I/O) fluid port (or "fluid port") 308, fluid control valves 310, and an output port (or "cleaning port") 312.

In some embodiments, the tagging agent containers 302 include one or more separate containers (or "tanks") operable to house tagging agents. For example, in the illustrated embodiment, the tagging agent containers 302 include four separate containers (or "tanks") 302*a*, 302*b*, 302*c* and 302*d* that are each operable to house a respective volume of a tagging agent, such as a noble gas. In some embodiments, the tagging agent containers 302 can be used to house the same or different tagging agents. For example, the first tagging agent container 302*a* may be used to house a first tagging agent (e.g., a first type of noble gas), the second tagging agent container 302*b* may be used to house a second tagging agent (e.g., a second type of noble gas), the third tagging agent container 302*c* may be used to house a third tagging agent (e.g., a third type of noble gas), the fourth tagging agent container 302*d* may be used to house a fourth tagging agent (e.g., a fourth type of noble gas). As described here, the tagging agents may be pumped from the tagging agent containers 302 into the rock of the formation 104 (by way of the fluid port 308) surrounding the wellbore 120. Although four tagging agent containers are depicted and described for illustration, embodiments may employ any suitable number of tagging agent containers in a similar manner.

In some embodiments, the fluid sample container 304 is a container (or "tank") operable to house a fluid sample (or a "reservoir fluid sample") extracted from the rock of the formation 104 (e.g., from the rock of the reservoir 102) surrounding the wellbore 120. As described here, reservoir fluid from the rock of the reservoir 102 surrounding the wellbore 120 may enter the tool 122 by way of the fluid port 308 and be routed (e.g., pumped by the pump 306) into the fluid sample container 304. Although one fluid sample container 304 is depicted and described for illustration, embodiments may employ any suitable number of fluid sample containers 304 in a similar manner.

In some embodiments, the fluid port 308 is operable to physically contact the rock surface of the formation 104 by penetrating the mud cake formed during overbalanced drilling on a wall 210 of the wellbore 120 to facilitate the communication of fluids between rock of the formation 104 and the tool 122. For example, the fluid port 308 may include an extendable conduit (e.g., a cylindrical tube) 320 that can be extended through the mud cake such that a distal end 322 of the conduit 320 contacts the rock surface behind the wall 210 of the wellbore 120. As described, during a reservoir fluid sampling operation, reservoir fluid may enter the fluid port 308. For example, the pump 306 may be operated to create a suction that draws reservoir fluid through the fluid port 308. As described, during an injection (or "tagging") operation, a substance (e.g., a tagging agent) may pass through the fluid port 308 and be forced into the formation 104. For example, the pump 306 may be operated to create pressure that forces tagging agents to pass through the fluid port 308, into the rock of the formation 104 faced to the distal end of the fluid port 308.

In some embodiments, the fluid pump (or "pump") 306 is operable to move fluids and other substances. For example, the pump 306 may be an electric mechanical pump having an inlet 330 operable to receive a substance (e.g., formation fluid or a noble gas tagging agent) and an outlet 332 operable to output the substance, and the pump 306 may operate to create a suction at the inlet 330 to draw fluids into the pump 306 (where it is pressurized) and to create a pressurized discharge of the substance at the outlet 332. As described, the pump 306 may be operated in coordination with fluid control valves 310 to pump, into the fluid sample container 304, reservoir fluid extracted from the reservoir 102 by way of the fluid port 308, or to pump, into the hydrocarbon reservoir by way of the fluid port 308, tagging agents from the tagging agent containers 302.

In some embodiments, the fluid control valves 310 are operable to control routing of fluids within the fluid communication system 206. For example, during a reservoir fluid sampling operation, the fluid control valves 310 may be controlled to respective opened or closed states, in combination, to route reservoir fluid extracted from the reservoir 102 by way of the fluid port 308, through the pump 306 and into the fluid sample container 304. As a further example, during an injection (or "tagging") operation, the fluid control valves 310 may be controlled to respective opened or closed states, in combination, to route tagging agents from the tagging agent containers 302, through the pump 306 and into the hydrocarbon reservoir by way of the fluid port 308. In some embodiments, each of the valves 310 may be operable in a closed state that inhibits fluid flow through (or "across") the valve 310 and in an open state that facilitates fluid flow through (or "across") the valve 310.

In some embodiments, the output port (or "cleaning port") 312 provides for expelling fluids from the tool 122, into the wellbore 120. For example, the output port 312 may extend from a lower portion of the tool 122 such that, when the tool 122 is disposed downhole (e.g., in the wellbore 120), in it is in fluid communication with a portion of the wellbore 120 located below the tool 122 (e.g., with the lower portion 224 of the wellbore 120). As described, the output port 312 may enable reservoir fluids to be flushed through the fluid communication system 206 prior to being routed into the fluid sample container 304. Thus, the output port 312 may enable the fluid communication system 206 to be "cleaned" of non-reservoir fluids (e.g., tagging agents or other fluids such as drilling mud filtrate) prior to a sample of the reservoir fluid being drawn into the fluid port 308 and being pumped to the fluid sample container 304.

In some embodiments, the fluid control valves 310 include a sample valve 310*a*, a sample-container valve 310*b*, an output/cleaning valve 310*c*, a tagging valve system 312 (e.g., including a first tagging valve 310*d*, a second tagging valve 310*e*, a third tagging valve 310*f* and a fourth tagging valve 310*g*), and an injection valve system 314 (e.g., including a first injection valve 310*h* and a second injection valve 310*i*).

In some embodiments, the sample valve 310*a* is disposed in a fluid path between the fluid port 308 and the inlet 330 of the pump 306, and is operable to regulate flow of fluid from the fluid port 308 to the inlet 330 of the pump 306.

In some embodiments, the sample-container valve 310*b* is disposed in a fluid path between the outlet 332 of the pump 306 and the fluid sample container 304, and is operable to regulate flow of fluid from the outlet 332 of the pump 306 to the fluid sample container 304.

In some embodiments, the output/cleaning valve 310*c* is disposed in a fluid path between the outlet 332 of the pump 306 and the output port 312, and is operable to regulate flow of fluid from the outlet 332 of the pump 306 to the output port 312.

In some embodiments, the tagging valve system 312 includes valves disposed in fluid paths between respective ones of the tagging agent containers 302 and the inlet 330 of the pump 306, and that are operable to regulate flow of fluids (e.g., tagging agents) from the respective tagging agent containers 302 to the inlet 330 of the pump 306. For example, in the illustrated embodiment, the tagging valve system 312 includes first, second, third and fourth tagging valves 310*d*, 310*e*, 310*f* and 310*g*, that are operable to regulate the flow of tagging agents from the respective first, second, third and fourth tagging agent containers 302*a*, 302*b*, 302 and 302*d* to the inlet 330 of the pump 306.

In some embodiments, the injection valve system 312 includes one or more valves disposed in a fluid path between the outlet 332 of the pump 306 and the fluid port 308, and that are operable to regulate flow of fluid (e.g., tagging agents) from the outlet 332 of the pump 306 to the fluid port 308. For example, in the illustrated embodiment, the injection valve system 312 includes a first and second injection valves 310*h* and 310*i* in series that are operable to regulate flow of fluid (e.g., tagging agents) from the outlet 332 of the pump 306 to the fluid port 308.

Figure 4A:
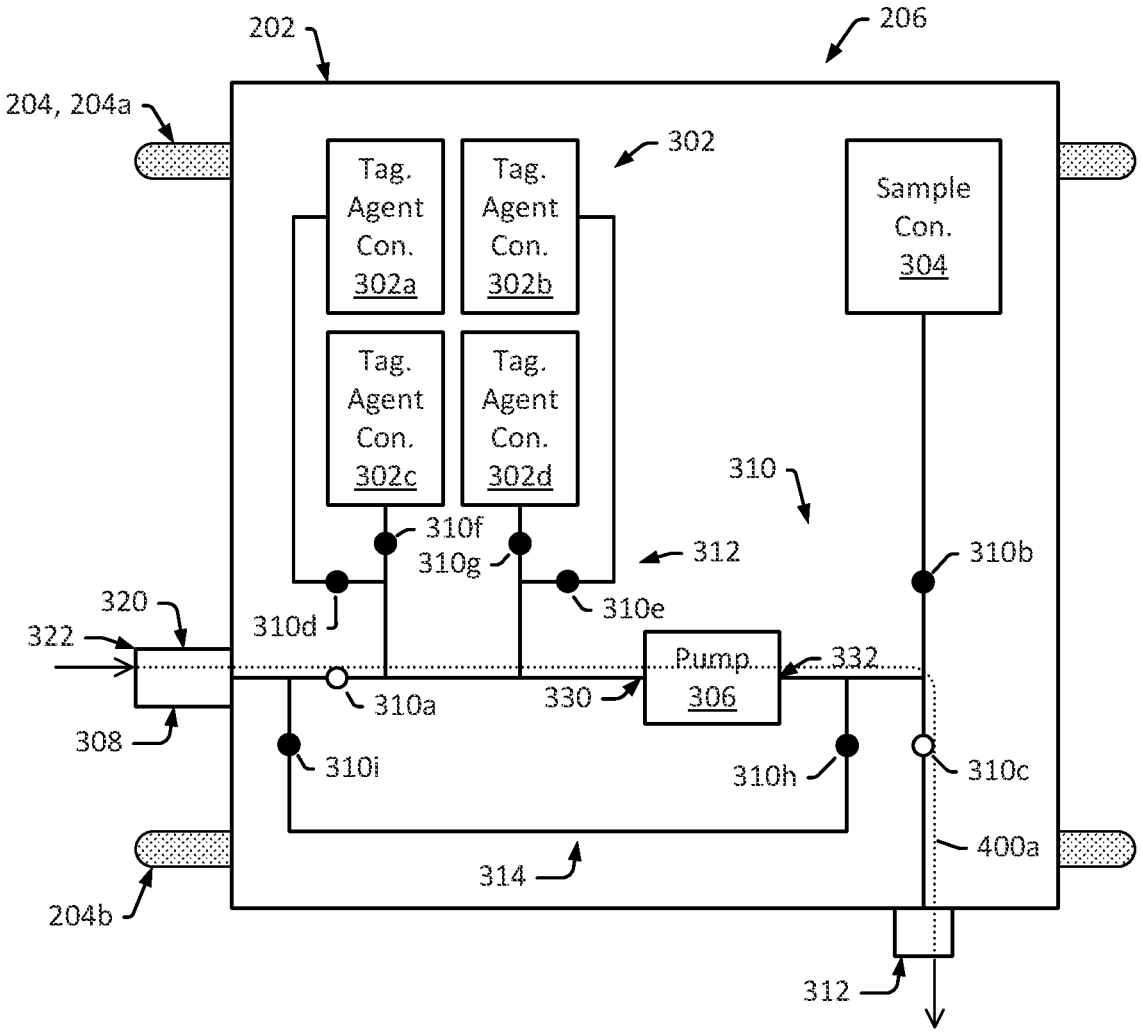
FIGS. 4A-4D are diagrams that illustrate operational aspects of a downhole fluid acquisition and injection system in a well in accordance with one or more embodiments.

Referencing FIG. 4A, in some embodiments the tool 122 is operable in a cleaning state that includes the packers 204 (e.g., including the upper and lower packers 204*a* and 204*b*) activated into sealing contact with the wall 210 of the wellbore 120, the fluid port 308 extended into contact with the surface of the formation 104, the pump 306 operating (e.g., to create a suction at the inlet 330 to draw fluids into the pump 306 (where it is pressurized) and to create a pressurized discharge of the substance at the outlet 332), the sample valve 310*a* and the output/cleaning valve 310*c* operating in an opened state (represented by the white circles) with the other valves operating in a closed state (represented by the black circles), to generate a flow of reservoir fluid into the fluid port 308 and out of the output/cleaning port 312 and into the lower or upper portion 224 of the wellbore 120 (as illustrated by arrow 400*a*).

Figure 4B:
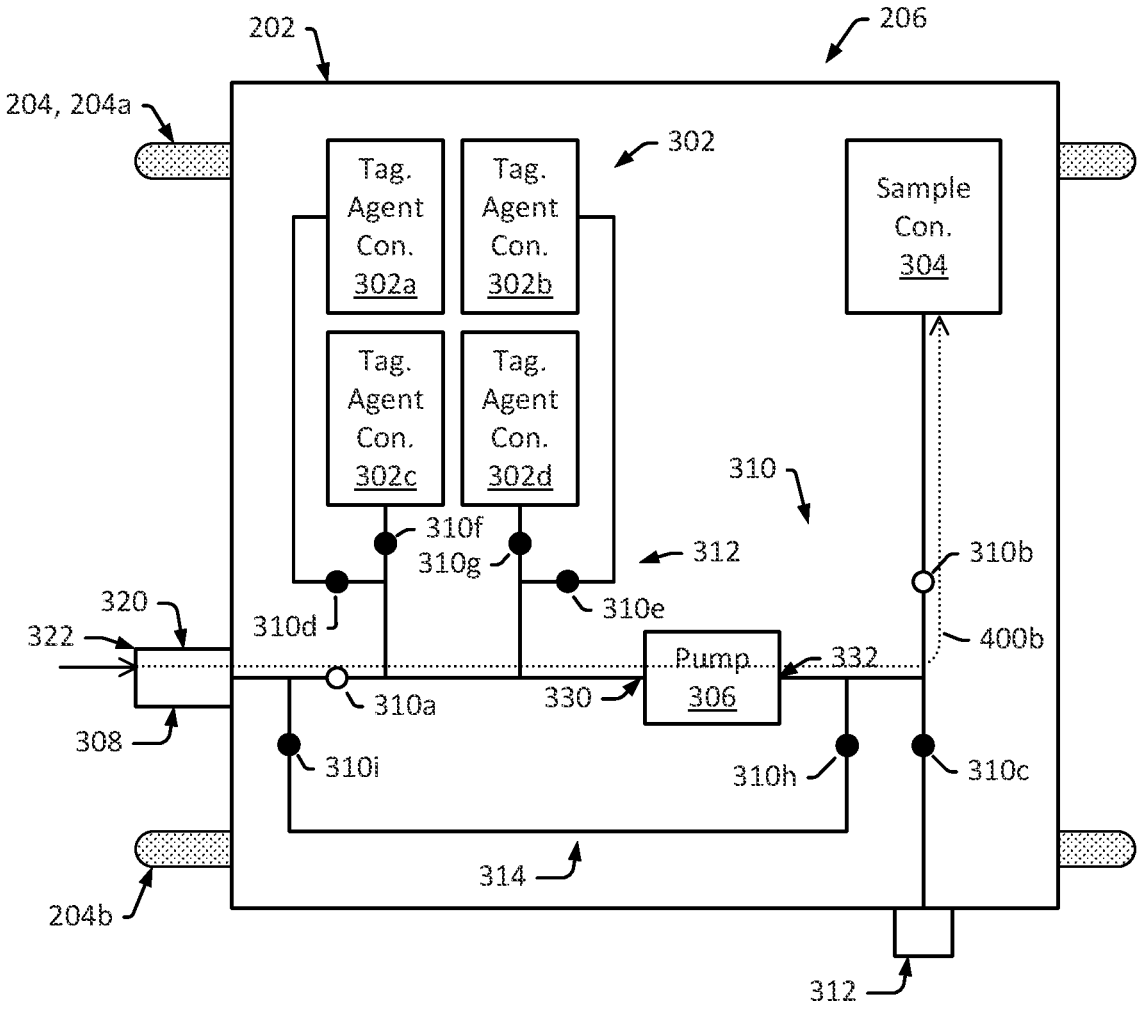

Referencing FIG. 4B, in some embodiments the tool 122 is operable in a sampling state that includes the isolation packers 204 (e.g., including the upper and lower packers 204*a* and 204*b*) activated into sealing contact with the wall 210 of the wellbore 120, the fluid port 308 extended into contact with the surface of the formation 104, the pump 306 operating (e.g., to create a suction at the inlet 330 to draw fluids into the pump 306 (where it is pressurized) and to create a pressurized discharge of the substance at the outlet 332), the sample valve 310*a* and the sample-container valve 310*b* operating in an opened state (represented by the white circles) with the other valves operating in a closed state (represented by the black circles), to generate a flow of reservoir fluid (cleaned according to the techniques illustrated in FIG. 4A with minimum drilling fluid filtrate contamination) into the fluid port 308 and into the sample container 304 (as illustrated by arrow 400*b*).

Figure 4C:
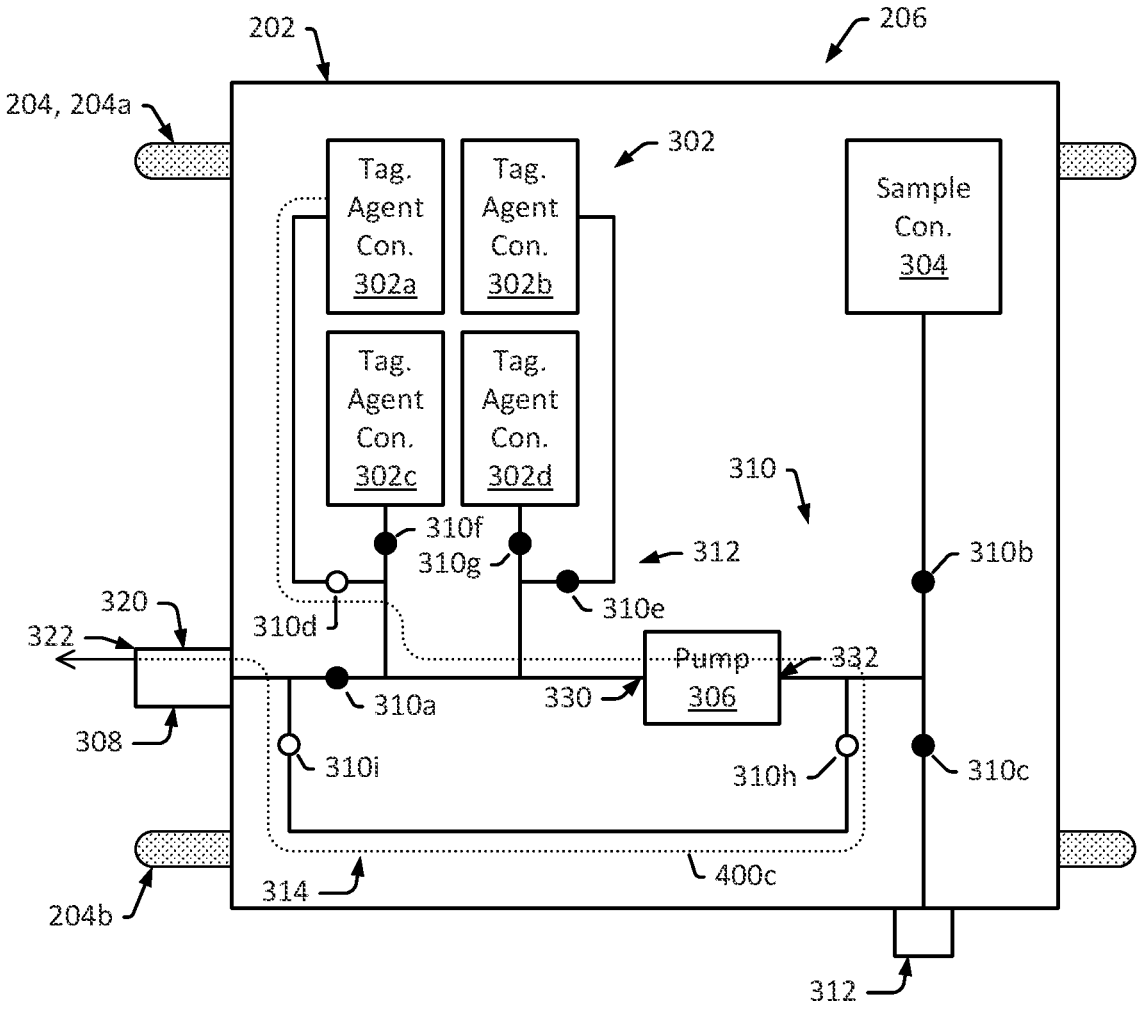
Figure 4D:
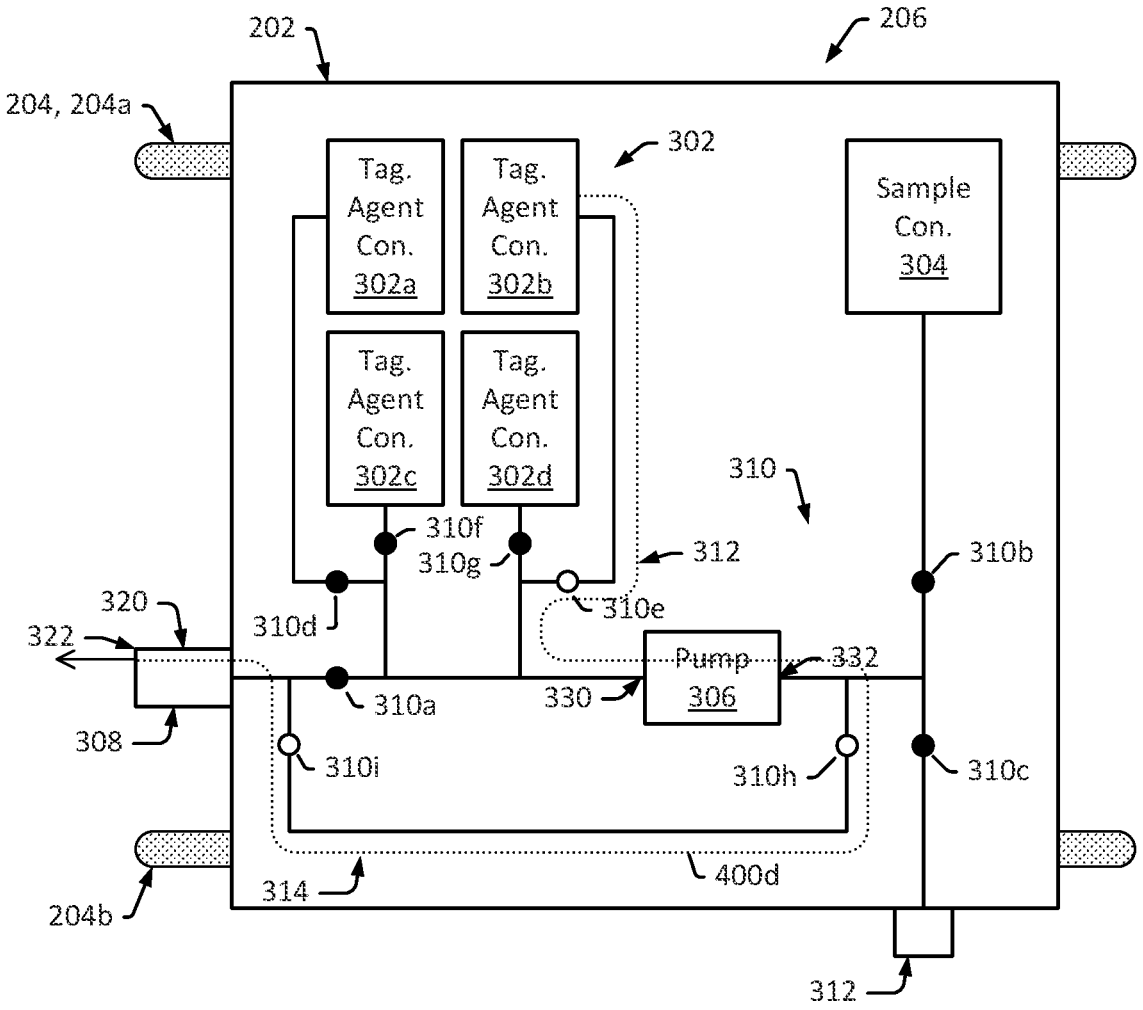

Referencing FIGS. 4C and 4D, in some embodiments the tool 122 is operable in a tagging state that includes the isolation packers 204 (e.g., including the upper and lower packers 204*a* and 204*b*) activated into sealing contact with the wall 210 of the wellbore 120, the fluid port 308 extended into contact with the surface of the formation 104, the pump 306 operating (e.g., to create a suction at the inlet 330 to draw fluids into the pump 306 (where it is pressurized) and to create a pressurized discharge of the substance at the outlet 332), a tagging valve 310 (e.g., one or more of the first, second, third and fourth tagging valves 310*d*, 310*e*, 310*f* and 310*g*) and the injection valve system 314 (e.g., including the first injection valve 310*h* and the second injection valve 310*i*) operating an open state (represented by the white circles) with the other valves operating in a closed state (represented by the black circles), to generate a flow of a tagging agent (e.g., the first, second, third or fourth tagging agent) out of a respective tagging agent container 304, through the fluid port 308 and into formation rock of the hydrocarbon reservoir 102, to inject the tagging agent into the formation rock of the hydrocarbon reservoir 102. For example, referencing FIG. 4C, the first tagging valve 310*d* may be opened in coordination with the opening/closing of the other valves 310 and operation of the pump 306 to draw the first tagging agent from the first tagging agent container 302*a*, and to push the first tagging agent through the fluid port 308 and into formation rock, to inject the first tagging agent into the formation rock proximate the outlet of the fluid port 308 (as illustrated by arrow 400*c*). As another example, referencing FIG. 4D, the second tagging valve 301*e* may be opened in coordination with the opening/closing of the other valves 310 and operation of the pump 306 to draw the second tagging agent from the second tagging agent container 302*b*, and to push the second tagging agent through the fluid port 308 and into formation rock of the hydrocarbon reservoir 102, to inject the second tagging agent into the formation rock proximate the outlet of the fluid port 308 (as illustrated by arrow 400*d*). Tagging agents from the third and fourth tagging agent containers 302*c* and 302*d* can be injected into the formation by a similar process that includes opening the respective third or fourth tagging valve 310*f* or 310*g*. In some embodiments, a combination of tagging agents can be injected by way of a similar process that involves simultaneously opening a combination of some or all of the tagging agent valves 310*d*-310*g* to create a "combined" tagging agent. For example, the first, second, third and fourth tagging valves 310*d*, 310*e*, 310*f* and 310*g* may be opened simultaneously to provide a combined tagging agent (e.g., a mixture of the tagging agents housed in the first, second, third and fourth tagging containers 302) that is injected into the formation rock proximate the outlet of the fluid port 308.

The tool 122 may enable reservoir fluid samples to be extracted from, or one or more tagging agents to be injected into, the reservoir at the same or different depth intervals, with a single run of the tool 122 into the wellbore. For example, the tool 122 may be run to a first depth in the wellbore 120 where a fluid sampling operation is conducted to draw a fluid sample from formation rock at the first depth into the fluid sample container 304, the tool 122 may be further run to second, third, fourth and fifth depths in the wellbore 120 where respective first, second, third and fourth tagging operations are conducted to inject first, second, third and fourth tagging agents, respectively, into formation rock at the respective depths, and the tool 122 may be retrieved from the wellbore 120.

In some embodiments, target depths in the well 106 are identified (e.g., based on open-hole logs or other formation information), formation fluid samples are acquired or tagging agents (e.g., noble gases) are injected at the target depths using the described hydrocarbon well downhole fluid acquisition and injection tool 122. The well 106 may, then, be operated (or "flowed) to generate flow of reservoir fluids (e.g., production fluids) from the wellbore 120, and the reservoir fluids may be monitored and assessed for the presence of tagging agents. The presence (or non-presence) of tagging agents and the fluid sample may be assessed to identify depth intervals (or "zones") that may (or may not be) candidates for stimulation or other operations, and corresponding operations may be conduct on some or all of the candidate zones.

Figure 5:
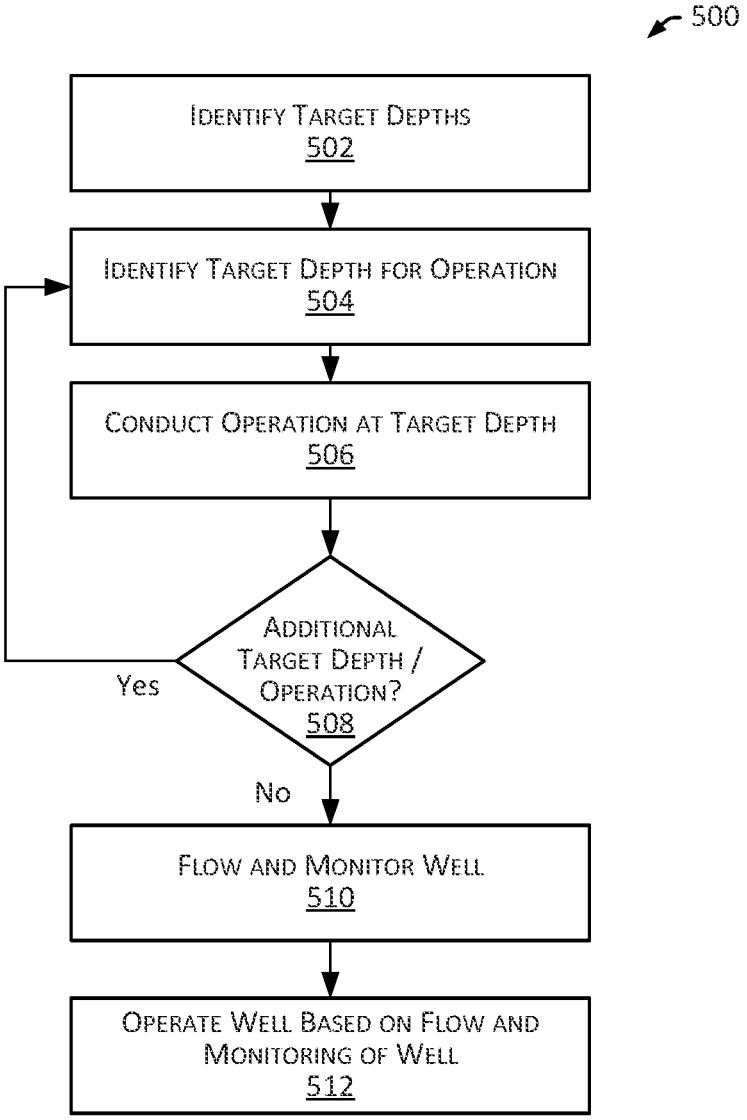
FIG. 5 is a flowchart that illustrates a method of employing a downhole fluid acquisition and injection system in accordance with one or more embodiments.

FIG. 5 is a flowchart that illustrates a method 500 of conducting operations in a well using a downhole fluid acquisition and injection system in accordance with one or more embodiments. In some embodiments, some or all the operations described with regard to the method 500 may be executed or controlled by the well control system 124 (or another operator of the well 106).

In some embodiments, method 500 includes identifying target depths (block 502). This may include determining one or more depths in a well at which a fluid acquisition and injection tool should be used to acquire a reservoir fluid sample or to inject tagging agents. For example, this may include the well control system 124 (or another operator of the well 106) determining a first depth in the wellbore 120 from which to acquire a reservoir fluid sample, or determining second, third, fourth and fifth depths in the wellbore 120 where respective first, second, third and fourth tagging operations are to be conducted to inject first, second, third and fourth tagging agents, respectively, into formation rock at the respective depths.

In some embodiments, target depths and associated operations to be conducted at the respective depths are based on assessment of reservoir data acquired for the well 106 or the reservoir 102. For example, the depths and operations may be determined based on assessment of surface data (e.g., including mud gas logging, drilling dynamics) and open hole logs are used for geological, geo-mechanical, petrophysical evaluations of the targeted reservoir (e.g., for reservoir temperature and pressure, mineralogy and lithology, mineral distribution and cementation, rock mechanical integrity and properties, porosity, permeability, reservoir fluid typing and saturation), reservoir fluid characterization (e.g., water chemistry and salinity, hydrocarbon composition and properties, noble and inert gases content), fluids for near wellbore formation matrix stimulation (e.g., type and properties of pre-treatment fluids and type and properties of injected fluids). In some embodiments, this further includes injection planning and optimization, where, depending on the geological rock units identified, and petrophysical properties (especially reservoir temperature, mineralogy, cementation, and rock mechanical properties) of the targeted reservoir and properties of fluids contained in the near wellbore reservoir region (such as chemistry of drilling fluid and reservoir fluids), the following may be determined: the type and amount of injected fluids, the type of matrix stimulation fluids, optimum amount of tagging fluids for maximum injection without breaking/fracturing the formation, injected fluid type varies depending the formation fluid content and properties, and the same rock type may be injected at different depth with different fluid if suspected of drilling fluid damage resulting in lowering its productivity. Based on this, depths for sampling and tagging, as well as the type of tagging agent may be selected, and the tool 122 may be loaded with the associated tagging agents.

In some embodiments, method 500 includes identifying a target depth for an operation (block 504). This may include determining one of the one or more depths in the well at which the fluid acquisition and injection tool is to be used to acquire a reservoir fluid sample or to inject tagging agents. For example, in a first iteration, this may include the well control system 124 (or another operator of the well 106) determining (based on the identified target depths and associated operations) that the tool 122 is to be advanced to a first depth to conduct a reservoir fluid sampling operation. In a second iteration, this may include the well control system 124 (or another operator of the well 106) determining that the tool 122 is to be advanced to a second depth to conduct a tagging operation, and so forth.

In some embodiments, method 500 includes conducting an operation at a target depth (block 506). This may include running the fluid acquisition and injection tool (e.g., on a wireline or similar tether) to a depth of the associated operation and conducting the operation at that depth. Continuing with the prior example, in a first iteration, this may include the well control system 124 (or another operator of the well 106) operating the well 106 to advance the tool 122 to the first depth and controlling the tool 122 to conduct a reservoir fluid sampling operation to capture a reservoir fluid sample from the first depth in the fluid sample container 304. In a second iteration, this may include the well control system 124 (or another operator of the well 106) operating the well 106 to advance the tool 122 to the second depth and controlling the tool 122 to conduct a first tagging operation to inject a first tagging agent into the formation rock at the second depth, and so forth.

In some embodiments, method 500 includes determining whether operations are to be conducted at additional target depths (block 508) and, if so, conducting a next iteration that includes conducting the operation at the depth (returning to blocks 504 and 506). If not, the method 500 can proceed to subsequent steps for operating the reservoir. Continuing with the above example, after advancing the tool 122 to the first depth and controlling the tool 122 to conduct a reservoir fluid sampling operation to capture a reservoir fluid sample from the first depth in the fluid sample container 304, the well control system 124 (or another operator of the well 106) may identify the second depth and the first tagging operation, and conduct a second iteration that includes operating the well 106 to advance the tool 122 to the second depth and controlling the tool 122 to conduct the first tagging operation to inject the first tagging agent into the formation rock at the second depth. Continuing with the above example, after advancing the tool 122 to the fifth depth and controlling the tool 122 to conduct the fourth tagging operation, the well control system 124 (or another operator of the well 106) may determine that no additional operations are to be conducted at additional target depths using the tool 122, and may proceed to retrieve the tool 122 from the wellbore 120 and continue with the well flowing/monitoring/stimulation operations (e.g., as described with regard to blocks 510 and 512).

In some embodiments, method 500 includes flowing and monitoring the well (block 510). This may include, subsequent to completing the sampling/tagging operations using the fluid acquisition and injection tool and retrieving the tool from the wellbore of the well, operating the well in a flowing state to produce reservoir fluids from the wellbore, monitoring the produced reservoir fluids for tagging agents, determining whether or not tagging agents are present in the produced fluids. For example, this may include subsequent to completing the sampling and four tagging operations using the tool 122 and retrieving the tool 122 from the wellbore 120 of the well 106, the well control system 124 (or another operator of the well 106) controlling the well 106 to operate in a flowing state to produce reservoir fluids from the wellbore 120, monitoring the produced reservoir fluids for tagging agents, and determining whether or not tagging agents are present in the produced fluids.

In some embodiments, method 500 includes operating the well based on flow and monitoring of the well (block 512). This may include, determining, based on the monitoring of the flow of the well, including a determination of whether or not tagging agents are present in the produced fluids and the type present, one or more depth intervals in the wellbore of the well that are candidates for a remediation operation, such as stimulation, and proceeding to conduct the associated operation(s) at the respective depth(s). For example, this may include the well control system 124 (or another operator of the well 106) determining, based on the monitoring of the flow of the well 106, including a determination that certain tagging agents are present in the produced fluids, a depth in the wellbore 120 of the well 106 that may benefit from a stimulation operation, and proceeding to conduct the associated stimulation operation (e.g., acid injection) at the depth in the wellbore 120.

Figure 6:
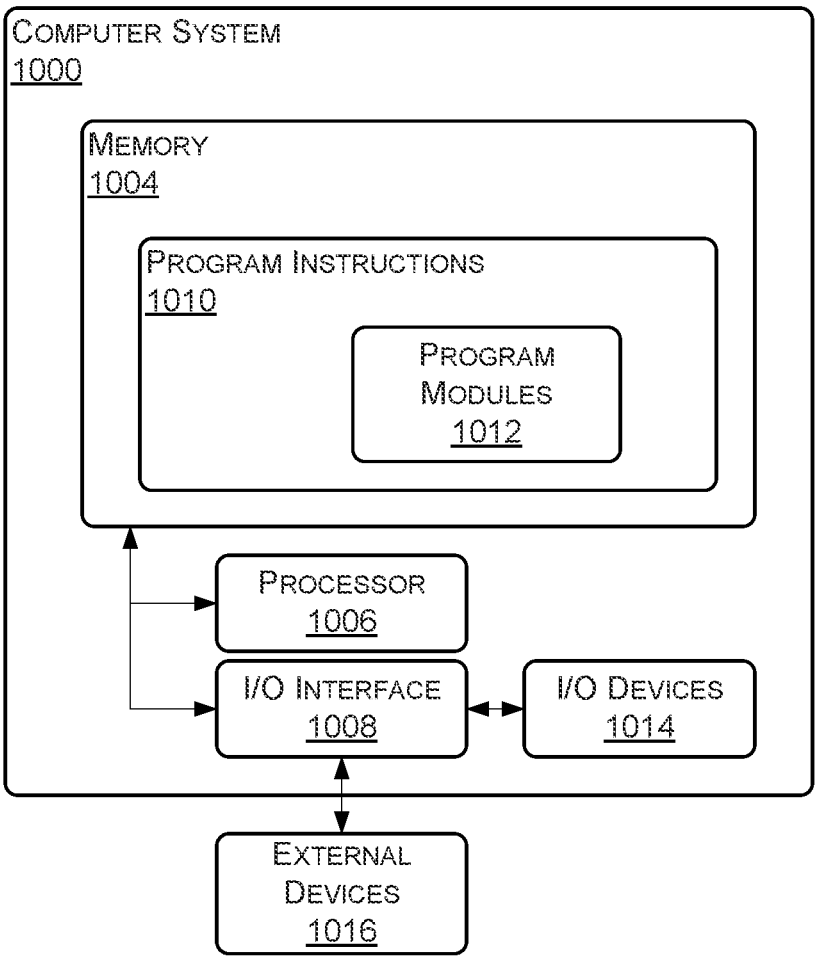
FIG. 6 is a diagram that illustrates an example computer system in accordance with one or more embodiments.

FIG. 6 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random-access memory (SRAM), synchronous dynamic RAM (SDRAM)), or bulk storage memory (e.g., CD-ROM or DVD-ROM, hard drives). The memory 1004 may include a non-transitory computer-readable storage medium having program instructions 1010 stored thereon. The program instructions 1010 may include program modules 1012 that are executable by a computer processor (e.g., by the processor 1006) to cause the functional operations described, such as those described with regard to the tool 122, the well control system 124 (or another operator of the well 106), or the method 500.

The processor 1006 may be any suitable processor capable of executing program instructions. The processor 1006 may include a central processing unit (CPU) that carries out program instructions (e.g., the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (e.g., an Industrial Ethernet connection) or a wireless connection (e.g., a Wi-Fi connection). The I/O interface 1008 may provide an interface for communication with one or more external devices 1016. In some embodiments, the I/O interface 1008 includes one or both of an antenna and a transceiver. The external devices 1016 may include, for example, devices of the well system 106 or the tool 122.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all the portions of the processes and methods may be implemented by one or more of the processors/modules/applications described here.

As used throughout this application, the word "may" is used in a permissive sense (that is, meaning having the potential to), rather than the mandatory sense (that is, meaning must). The words "include," "including," and "includes" mean including, but not limited to. As used throughout this application, the singular forms "a," "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic, or magnetic quantities within memories, registers, or other information storage devices, transmission devices, or display devices of the special purpose computer or similar special purpose electronic processing/computing device.

What is claimed is:

1. A hydrocarbon well downhole fluid acquisition and injection system comprising:

a downhole fluid acquisition and injection tool configured to be disposed downhole in a wellbore of a hydrocarbon well extending into a formation containing a hydrocarbon reservoir, the downhole fluid acquisition and injection tool comprising:

tagging agent containers configured to house tagging agents, the containers comprising:

a first tagging agent container configured to house a first tagging agent; and a second tagging agent container configured to house a second tagging agent;

a fluid sample container configured to house reservoir fluid extracted from the hydrocarbon reservoir;

a fluid port configured to penetrate a mud cake and contact a surface of the formation to facilitate the communication of fluids between the hydrocarbon reservoir and the downhole fluid acquisition and injection tool;

a fluid pump configured to:

pump, into the fluid sample container, reservoir fluid extracted from the hydrocarbon reservoir by way of the fluid port; and pump, into the hydrocarbon reservoir by way of the fluid port, tagging agents from the tagging agent containers;

fluid control valves configured to:

route reservoir fluid extracted from the hydrocarbon reservoir by way of the fluid port to the pump and into the fluid sample container; and route tagging agents from the tagging agent containers to the pump and into the hydrocarbon reservoir by way of the fluid port;

an isolation system configured to isolate a test interval of the formation from interferences of adjacent formation or the wellbore, the isolation system comprising:

an upper packer configured to seal against the wall of the wellbore to isolate the test interval from an upper portion of the wellbore located up-hole of the downhole fluid acquisition and injection tool; and a lower packer configured to seal against the wall of the wellbore to isolate the test interval from a lower portion of the wellbore located downhole of the downhole fluid acquisition and injection tool;

an output/cleaning port configured to be in fluid communication with the lower or upper portion of the wellbore;

the fluid control valves comprising:

a sample valve configured to regulate flow of reservoir fluid between the fluid port and an inlet of the pump;

a sample-container valve configured to regulate flow of reservoir fluid between the pump and the sample container;

an output/cleaning valve configured to regulate flow of reservoir fluid between an output of the pump and the output/cleaning port; and a tagging valve system configured to regulate flow of tagging agents between tagging agent containers and the input of the pump, the tagging valve system comprising:

a first tagging valve configured to regulate flow of the first tagging agent between the first tagging agent container and the inlet of the pump; and a second tagging valve configured to regulate flow of the second tagging agent between the second tagging agent container and the inlet of the pump; and injection valve system configured to regulate flow of the tagging agents between the output of the pump and the fluid port, the injection valve system comprising:

a first injection valve between the output of the pump and the fluid port; and a second injection valve between the first injection valve and the fluid port, wherein the downhole fluid acquisition and injection tool is configured to operate in a cleaning state that comprises the upper packer and lower packer in sealing contact with the wall of the wellbore, the fluid port in contact with the surface of the formation, the pump operating, and the following valves operating in an open state:

the sample valve; and the output/cleaning valve, to generate a flow of reservoir fluid into the fluid port and out of the output/cleaning port and into the lower or upper portion of the wellbore, wherein the downhole fluid acquisition and injection tool is configured to operate in a sampling state that comprises the upper packer and lower packer in sealing contact with the wall of the wellbore, the fluid port in contact with the wall of the wellbore, the pump operating, and the following valves operating in an open state:

the sample valve; and the sample-container valve, to generate a flow of reservoir fluid into the fluid port and into the sample container, wherein the downhole fluid acquisition and injection tool is configured to operate in a first tagging state that comprises the upper packer and lower packer in sealing contact with the wall of the wellbore, the fluid port in contact with the surface of the formation, the pump operating, and the following valves operating in an open state:

the first tagging valve;

the first injection valve; and the second injection valve, to generate a flow of the first tagging agent out of the first tagging agent container, through the fluid port and into formation rock of the hydrocarbon reservoir, to inject the first tagging agent into the formation rock of the hydrocarbon reservoir, and wherein the downhole fluid acquisition and injection tool is configured to operate in a second tagging state that comprises the upper packer and lower packer in sealing contact with the wall of the wellbore, the fluid port in contact with the surface of the formation, the pump operating, and the following valves operating in an open state:

the second tagging valve;

the first injection valve; and the second injection valve, to generate a flow of the second tagging agent out of the second tagging agent container, through the fluid port and into formation rock of the hydrocarbon reservoir, to inject the second tagging agent into the formation rock of the hydrocarbon reservoir.

2. The system of claim 1, further comprising a well control system configured to:

control the well to operate in a flowing state to produce reservoir fluids from the formation;

monitor the produced reservoir fluids for tagging agents;

determine the presence of the first or second tagging agent;

determine, responsive to determining the presence of the first or second tagging agent, a depth interval of the hydrocarbon well that is a candidate for stimulation; and conduct, responsive to determining the depth interval of the hydrocarbon well that is a candidate for the stimulation, a stimulation operation on the depth interval of the formation of the hydrocarbon well.

3. The system of claim 2, wherein the stimulation operation comprises injection of a stimulation agent into formation rock at the depth interval of the wellbore of the hydrocarbon well.

4. A hydrocarbon well downhole fluid acquisition and injection system comprising:

a downhole fluid acquisition and injection tool configured to be disposed downhole in a wellbore of a hydrocarbon well extending into a formation containing a hydrocarbon reservoir, the downhole fluid acquisition and injection tool comprising:

tagging agent containers configured to house tagging agents, the containers comprising:

a first tagging agent container configured to house a first tagging agent; and a second tagging agent container configured to house a second tagging agent;

a fluid sample container configured to house reservoir fluid extracted from the hydrocarbon reservoir;

a fluid port configured to penetrate a mud cake and contact a surface of the formation to facilitate the communication of fluids between the hydrocarbon reservoir and the downhole fluid acquisition and injection tool;

a fluid pump configured to:

pump, into the fluid sample container, reservoir fluid extracted from the hydrocarbon reservoir by way of the fluid port; and pump, into the hydrocarbon reservoir by way of the fluid port, tagging agents from the tagging agent containers;

fluid control valves configured to:

route reservoir fluid extracted from the hydrocarbon reservoir by way of the fluid port to the pump and into the fluid sample container; and route tagging agents from the tagging agent containers to the pump and into the hydrocarbon reservoir by way of the fluid port;

an isolation system configured to isolate a test interval of the formation from interference from adjacent formations or from the wellbore, the isolation system comprising:

an upper packer configured to seal against the wall of the wellbore to isolate the test interval from an upper portion of the wellbore located up-hole of the downhole fluid acquisition and injection tool; and a lower packer configured to seal against the wall of the wellbore to isolate the test interval from a lower portion of the wellbore located down-hole of the downhole fluid acquisition and injection tool;

an output/cleaning port configured to be in fluid communication with the lower or upper portion of the wellbore;

the fluid control valves comprising:

a sample valve configured to regulate flow of reservoir fluid between the fluid port and an inlet of the pump;

a sample-container valve configured to regulate flow of reservoir fluid between the pump and the sample container;

an output/cleaning valve configured to regulate flow of reservoir fluid between an output of the pump and the output/cleaning port; and a tagging valve system configured to regulate flow of tagging agents between tagging agent containers and the input of the pump, the tagging valve system comprising:

a first tagging valve configured to regulate flow of the first tagging agent between the first tagging agent container and the inlet of the pump; and a second tagging valve configured to regulate flow of the second tagging agent between the second tagging agent container and the inlet of the pump; and injection valve system configured to regulate flow of the tagging agents between the output of the pump and the fluid port, the injection valve system comprising a first injection valve between the output of the pump and the fluid port.

5. The system of claim 4, wherein the downhole fluid acquisition and injection tool is configured to operate in a cleaning state that comprises the upper packer and lower packer in sealing contact with the wall of the wellbore, the fluid port in contact with the surface of the formation, the pump operating and the following valves operating in an open state:

the sample valve; and the output/cleaning valve, to generate a flow of reservoir fluid into the fluid port and out of the output/cleaning port and into the lower or upper portion of the wellbore.

6. The system of claim 4, wherein the downhole fluid acquisition and injection tool is configured to operate in a sampling state that comprises the upper packer and lower packer in sealing contact with the wall of the wellbore, the fluid port in contact with the surface of the formation, the pump operating and the following valves operating in an open state:

the sample valve; and the sample-container valve, to generate a flow of reservoir fluid into the fluid port and into the sample container.

7. The system of claim 4, wherein the downhole fluid acquisition and injection tool is configured to operate in a first tagging state that comprises the upper packer and lower packer in sealing contact with the wall of the wellbore, the fluid port in contact with the surface of the formation, the pump operating and the following valves operating in an open state:

the first tagging valve;

the first injection valve; and the second injection valve, to generate a flow of the first tagging agent out of the first tagging agent container, through the fluid port and into formation rock of the hydrocarbon reservoir, to inject the first tagging agent into the formation rock of the hydrocarbon reservoir.

8. The system of claim 4, wherein the downhole fluid acquisition and injection tool is configured to operate in a second tagging state that comprises the upper packer and lower packer in sealing contact with the wall of the wellbore, the fluid port in contact with the surface of the formation, the pump operating and the following valves operating in an open state:

the second tagging valve;

the first injection valve; and the second injection valve, to generate a flow of the second tagging agent out of the second tagging agent container, through the fluid port and into formation rock of the hydrocarbon reservoir, to inject the second tagging agent into the formation rock of the hydrocarbon reservoir.

9. The system of claim 4, wherein the injection valve system comprises a second injection valve between the first injection valve and the fluid port.

10. The system of claim 4, further comprising a well control system configured to:

control the well to operate in a flowing state to produce reservoir fluids from the formation;

monitor the produced reservoir fluids for tagging agents;

determine the presence of the first or second tagging agent;

determine, responsive to determining the presence of the first or second tagging agent, a depth interval of the hydrocarbon well that is a candidate for stimulation; and conduct, responsive to determining the depth interval of the hydrocarbon well that is a candidate for the stimulation, a stimulation operation on the depth interval of the wellbore of the hydrocarbon well.

11. The system of claim 10, wherein the stimulation operation comprises injection of a stimulation agent into formation rock at the depth interval of the wellbore of the hydrocarbon well.

12. A method of operating a hydrocarbon well, comprising:

disposing a downhole fluid acquisition and injection tool downhole in a wellbore of a hydrocarbon well extending into a formation containing a hydrocarbon reservoir, the downhole fluid acquisition and injection tool comprising:

tagging agent containers configured to house tagging agents, the containers comprising:

a first tagging agent container configured to house a first tagging agent; and a second tagging agent container configured to house a second tagging agent;

a fluid sample container configured to house reservoir fluid extracted from the hydrocarbon reservoir;

a fluid port configured to contact a surface of the formation to facilitate the communication of fluids between the hydrocarbon reservoir and the downhole fluid acquisition and injection tool;

a fluid pump configured to:

pump, into the fluid sample container, reservoir fluid extracted from the hydrocarbon reservoir by way of the fluid port; and pump, into the hydrocarbon reservoir by way of the fluid port, tagging agents from the tagging agent containers;

fluid control valves configured to:

route reservoir fluid extracted from the hydrocarbon reservoir by way of the fluid port to the pump and into the fluid sample container; and route tagging agents from the tagging agents containers to the pump and into the hydrocarbon reservoir by way of the fluid port;

an isolation system configured to isolate a test interval of the formation from interference of adjacent formations or the wellbore, the test interval comprising an annular region of the wellbore between the wall of the wellbore and a body of the downhole fluid acquisition and injection tool, the isolation system comprising:

an upper packer configured to seal against the wall of the wellbore to isolate the test interval from an upper portion of the wellbore located up-hole of the downhole fluid acquisition and injection tool; and a lower packer configured to seal against the wall of the wellbore to isolate the test interval from a lower portion of the wellbore located down-hole of the downhole fluid acquisition and injection tool;

an output/cleaning port configured to be in fluid communication with the lower or upper portion of the wellbore;

the fluid control valves comprising:

a sample valve configured to regulate flow of reservoir fluid between the fluid port and an inlet of the pump;

a sample-container valve configured to regulate flow of reservoir fluid between the pump and the sample container;

an output/cleaning valve configured to regulate flow of reservoir fluid between an output of the pump and the output/cleaning port; and a tagging valve system configured to regulate flow of tagging agents between tagging agent containers and the input of the pump, the tagging valve system comprising:

a first tagging valve configured to regulate flow of the first tagging agent between the first tagging agent container and the inlet of the pump; and a second tagging valve configured to regulate flow of the second tagging agent between the second tagging agent container and the inlet of the pump; and injection valve system configured to regulate flow of the tagging agents between the output of the pump and the fluid port, the injection valve system comprising a first injection valve between the output of the pump and the fluid port; and operating the downhole fluid acquisition and injection tool to conduct a sampling operation to collect a fluid sample from the reservoir and one or more tagging operations at different depths along the wellbore to inject the first and second tagging agents into the reservoir.

13. The method of claim 12, further comprising operating the downhole fluid acquisition and injection tool in a cleaning state that comprises the upper packer and lower packer in sealing contact with the wall of the wellbore, the fluid port in contact with the surface of the formation, the pump operating and the following valves operating in an open state:

the sample valve; and the output/cleaning valve, to generate a flow of reservoir fluid into the fluid port and out of the output/cleaning port and into the lower or upper portion of the wellbore.

14. The method of claim 12, wherein the sampling operation comprises operating the downhole fluid acquisition and injection tool in a sampling state that comprises the upper packer and lower packer in sealing contact with the wall of the wellbore, the fluid port in contact with the surface of the formation, the pump operating and the following valves operating in an open state:

the sample valve; and the sample-container valve, to generate a flow of reservoir fluid into the fluid port and into the sample container.

15. The method of claim 12, wherein a first tagging operation of the one or more tagging operations comprise operating the downhole fluid acquisition and injection tool in a first tagging state that comprises the upper packer and lower packer in sealing contact with the wall of the wellbore, the fluid port in contact with the surface of the formation, the pump operating and the following valves operating in an open state:

the first tagging valve;

the first injection valve; and the second injection valve, to generate a flow of the first tagging agent out of the first tagging agent container, through the fluid port and into formation rock of the hydrocarbon reservoir, to inject the first tagging agent into the formation rock of the hydrocarbon reservoir.

16. The method of claim 15, wherein a first tagging operation of the one or more tagging operations comprise operating the downhole fluid acquisition and injection tool in a second tagging state that comprises the upper packer and lower packer in sealing contact with the wall of the wellbore, the fluid port in contact with the surface of the formation, the pump operating and the following valves operating in an open state:

the second tagging valve;

the first injection valve; and the second injection valve, to generate a flow of the second tagging agent out of the second tagging agent container, through the fluid port and into formation rock of the hydrocarbon reservoir, to inject the second tagging agent into the formation rock of the hydrocarbon reservoir.

17. The method of claim 12, wherein the injection valve system comprises a second injection valve between the first injection valve and the fluid port.

18. The method of claim 12, further comprising:

controlling the well to operate in a flowing state to produce reservoir fluids from the formation;

monitoring the produced reservoir fluids for tagging agents;

determining the presence of the first or second tagging agent;

determining, responsive to determining the presence of the first or second tagging agent, a depth interval of the hydrocarbon well that is a candidate for stimulation; and conducting, responsive to determining the depth interval of the hydrocarbon well that is a candidate for the stimulation, a stimulation operation on the depth interval of the formation of the hydrocarbon well.

19. The method of claim 18, wherein the stimulation operation comprises injection of a stimulation agent into formation rock at the depth interval of the wellbore of the hydrocarbon well.

20. The method of claim 12, wherein the sampling operation and the one or more tagging operations are conducted during a single run of the downhole fluid acquisition and injection tool in the wellbore of the well.

* * * * *